US011524887B2

(12) United States Patent
Davis

(10) Patent No.: US 11,524,887 B2
(45) Date of Patent: Dec. 13, 2022

(54) LIQUID CONTAINER TILTING APPARATUS AND METHOD

(71) Applicant: Keith Lauster Davis, Tooele, UT (US)

(72) Inventor: Keith Lauster Davis, Tooele, UT (US)

(73) Assignee: Keith Lauster Davis, Tooele, UT (US)

( * ) Notice: Subject to any disclaimer, the term of this patent is extended or adjusted under 35 U.S.C. 154(b) by 0 days.

(21) Appl. No.: 17/231,525

(22) Filed: Apr. 15, 2021

(65) Prior Publication Data

US 2022/0332564 A1 Oct. 20, 2022

(51) Int. Cl.
*B67D 3/00* (2006.01)

(52) U.S. Cl.
CPC ..... *B67D 3/0051* (2013.01); *B67D 3/0054* (2013.01); *B67D 3/0083* (2013.01); *B67D 2210/00031* (2013.01)

(58) Field of Classification Search
CPC ..... B67D 3/0051; B67D 3/0083; B67D 2210/00031; B67D 2210/00; B67D 3/0054
See application file for complete search history.

(56) References Cited

U.S. PATENT DOCUMENTS 5,217,193 A * 6/1993 Drucker ..... B44D 3/14 248/148
5,772,163 A * 6/1998 Young ..... A45D 40/265 248/139
5,934,627 A * 8/1999 Lewis ..... E04D 15/00 248/148
6,386,393 B1 * 5/2002 Paulovich ..... B67D 3/0029 211/80
6,533,227 B1 * 3/2003 Rom ..... B44D 3/14 248/148
6,742,727 B1 * 6/2004 Peterson, Jr. ..... F02M 61/1853 239/533.11
7,275,662 B1 * 10/2007 Milcetich ..... B67D 3/0083 211/74
7,651,060 B2 * 1/2010 Roth ..... B01F 15/00733 248/146
7,887,016 B2 * 2/2011 Gunsaullus ..... E06C 7/14 248/238
9,586,803 B1 * 3/2017 Snyker ..... A47B 73/00
9,593,801 B2 * 3/2017 Love ..... B67D 3/0083
9,708,171 B1 * 7/2017 Highum ..... B67D 3/0083
10,011,475 B1 * 7/2018 Brekke ..... B65G 65/23
10,189,298 B2 * 1/2019 Kahra ..... B05B 9/00
10,933,650 B2 * 3/2021 Mashima ..... B41J 2/17566
(Continued)

FOREIGN PATENT DOCUMENTS

FR 2630097 A * 10/1989 ..... B67D 3/0051
FR 3056973 A1 * 4/2018 ..... B67D 7/78
(Continued)

*Primary Examiner* — Frederick C Nicolas

(57) ABSTRACT

A liquid container tilting apparatus designed for household and commercial use; made from a resilient material, capable of automatically tilting to a maximum tilt angle to optimize the draining of the last 1-6 cups of liquid from the container. As the liquid from the container drains, the tilting angle increases. The tilting apparatus is made of a base, a platform lever and a basket. The platform lever is part of the base. The basket holds the liquid container securely to the platform lever. The liquid container tilting apparatus can be cleaned and stored inside the liquid container or hung.

1 Claim, 10 Drawing Sheets

(56) References Cited

U.S. PATENT DOCUMENTS

| | | | | |
|---|---|---|---|---|
| 11,117,418 | B2 * | 9/2021 | Kauffman | B65D 21/0209 |
| 2010/0078448 | A1 * | 4/2010 | Kpabar | B67D 3/0083 222/108 |
| 2010/0155419 | A1 * | 6/2010 | Nishino | B67D 3/0051 222/81 |
| 2012/0104041 | A1 * | 5/2012 | Coleman | B67D 3/0054 222/103 |
| 2012/0305595 | A1 * | 12/2012 | Braun | B67D 3/0009 222/105 |
| 2015/0108169 | A1 * | 4/2015 | Bishel | A47G 23/0241 222/166 |
| 2017/0050764 | A1 * | 2/2017 | Caul, III | F16B 47/00 |
| 2018/0148310 | A1 * | 5/2018 | Bishel | B67D 3/0051 |

FOREIGN PATENT DOCUMENTS

| | | | | |
|---|---|---|---|---|
| GB | 2272878 | A * | 6/1994 | B67D 3/0083 |
| GB | 2292727 | A * | 3/1996 | B67D 3/0083 |
| WO | WO-0149598 | A1 * | 7/2001 | B67D 3/0083 |

* cited by examiner

LIQUID CONTAINER TILTING APPARATUS AND METHOD

BACKGROUND

The Field of the Invention

This invention relates to liquid containment, dispensing, and more particularly, to novel systems and methods of draining the last dregs of liquid from the container.

Background Art

Portable liquid containers allow for the economical refreshment of guests in areas that were not built with expensive, inflexible liquid containers. These portable liquid containers allow for a large variety of both cold and hot drinks to be served, and increase capacity and flexibility for change in liquid need.

Spouts and Spigots are used to control the flow of the liquid out of the liquid container. Depending on the size of the spout or spigot determines the placement location on or in the liquid container. The majority of spouts and spigots are placed within 1½ inches of the bottom of the container. When sitting level on a table approximately 6 cups of liquid remain in a 5-gallon container below the drain opening for the spout or spigot.

SUMMARY OF THE INVENTION

In view of the foregoing, in accordance with the invention as embodied and broadly described herein, the liquid container tilting apparatus uses the laws of physics and potential energy stored in the folded resilient lever that forms the platform and base to tip the liquid container up and forward allowing gravity to pull the liquid inside to a level puddle or pool above the spout and spigot drain hole within the liquid container.

The combined weight of the container and the liquid stored inside is sufficient to overcome the potential energy stored in the folded lever and base. As the container is drained, the weight sitting on the lever decreases. At a point in time as the liquid is drained, the potential stored energy is sufficient to start lifting the lever and tilting the liquid container up and forward. The flow of the liquid out of the spout or spigot remains constant until the container is empty as defined as less than 1 cup of liquid.

The maximum (optimum) angle of the lever platform and the container is controlled by bolt anchors, lever range guide and the platform lever stop. The movement of the platform lever is gradual from the level position to approximately 30 degrees of tilting. The center of gravity for the container and the liquid inside remain to the rear of the tipping point of the container as the platform rises. In the case of a 5-gallon liquid container, all but 5-7 ounces of liquid can be drained and served from the liquid container.

DETAILED DESCRIPTION OF THE PREFERRED EMBODIMENTS

Figure 1:
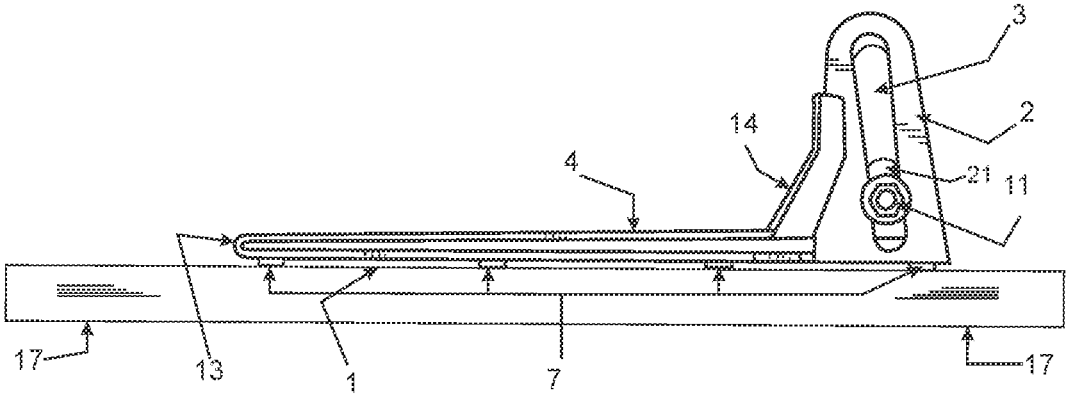
FIG. 1 is a side view of one embodiment of a liquid container tilting apparatus including the base, guard rail, lever range stop, bolt anchors, platform lever, side stops, front stops, anti-skid buttons on the bottom of the base to keep the liquid container tilting apparatus from moving while in use. The lever platform is represented as if it was in the full down or level position.

It will be readily understood that the components of the present invention, as generally described and illustrated in the drawings herein, could be made from a wide variety of different resilient materials, arranged and redesigned in a wide variety of different configurations. Thus, the following more detailed description of the embodiments of the system and method of the present invention, as represented in the drawings, is not intended to limit the scope of the invention, but is merely representative of the liquid container tilting apparatus and methods in accordance with the invention. The illustrated embodiments will be best understood by reference to the drawings, wherein like parts are designated by like numerals throughout.

Referring to FIG. 1, the liquid container tilting apparatus includes a base 1, lever range guide 2 with travel limit opening 3, platform lever 4, side stabilizers 14, anti-skid buttons 7, acute angle fold 13, bolt anchors 21, and the nut and washer on the platform lever stop bolt 11. The lever platform is represented as if it is in the full down or level position.

Figure 2:
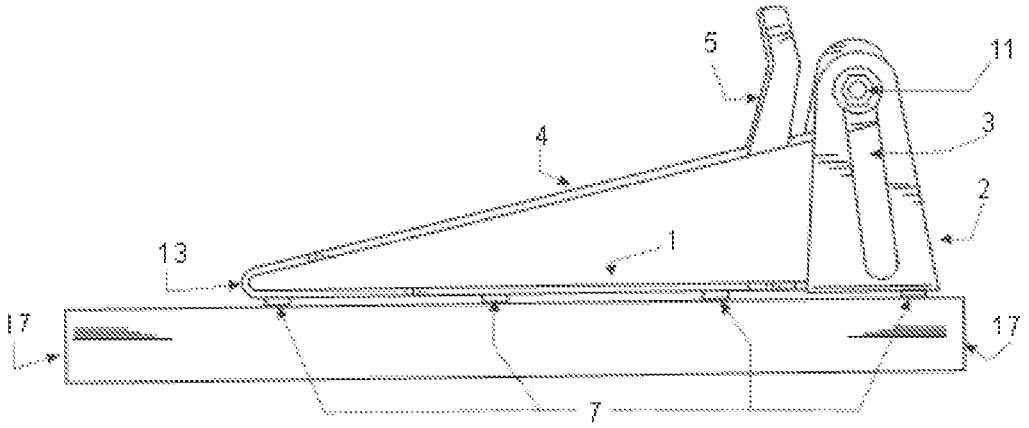
FIG. 2 is a side view of one embodiment of a liquid container tilting apparatus including the base, guard rail, lever range stop, platform lever, side stops, front stops, anti-skid buttons on the bottom of the base to keep the liquid container tilting apparatus from moving while in use. The lever platform is represented as if it was in the full up position.

Referring to FIG. 2, the liquid container tilting apparatus includes a base 1, lever range guide 2 with travel limit opening 3, platform lever 4, side stabilizers 14, anti-skid buttons 7, acute angle fold 13, and the nut and washer on the platform lever stop bolt 11. The lever platform is represented as if it is in the full up or tilting position.

Figure 3:
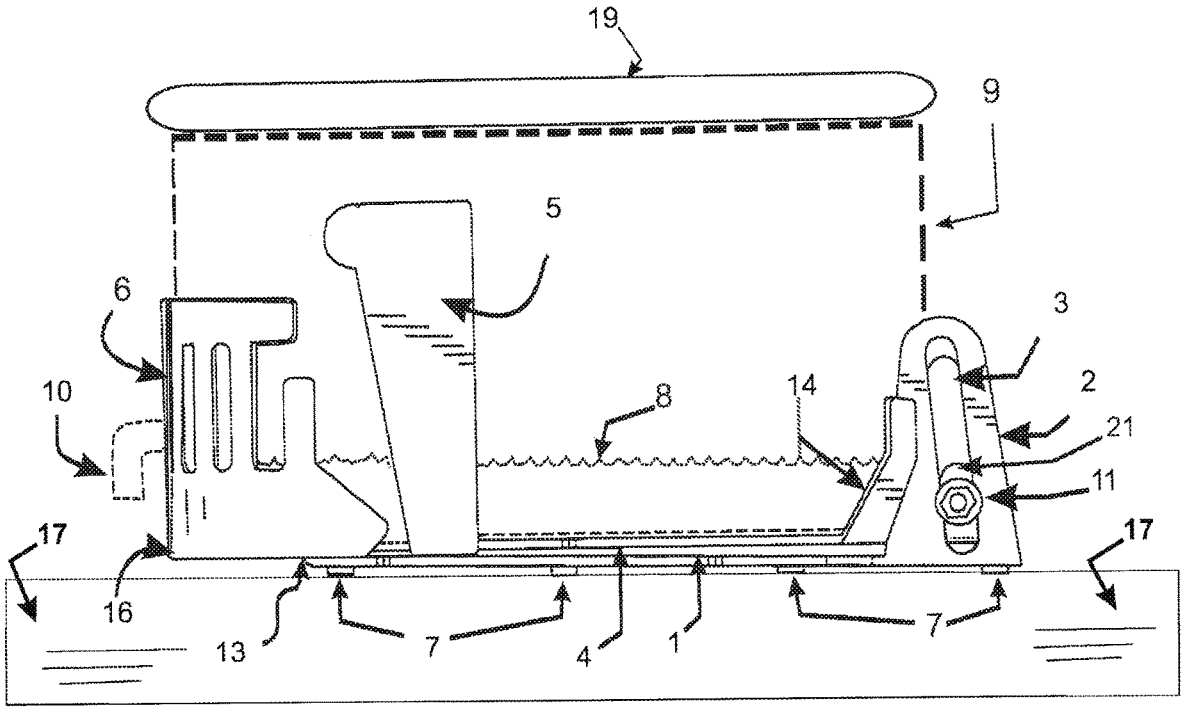
FIG. 3 is a side view of one embodiment of a system including the base, guard rail, lever range stop, bolt anchors, platform lever, side stops, front stops, anti-skid buttons on the bottom of the base to keep the liquid container tilting apparatus from moving while in use. The lever platform is represented as if it was in the full down or level position. The liquid container with spout or spigot is represented in the level or static position with the dregs of the liquid below the spout or spigot drain hole.

Referring to FIG. 3, the liquid container tilting apparatus includes the base 1, lever range stop 2 with travel limit opening 3, platform lever 4, side stabilizers 14, anti-skid buttons 7, acute angle fold 13, bolt anchors 21, and the nut and washer on the platform lever stop bolt 11. It includes the basket with side arms 5 and front fence 6, including the representation of a liquid container 9, with the top level of the liquid 8, depicted at or above the bottom of the spigot/spout and interior drain opening 10. The lever platform is represented as if it is in the full down or level position.

Figure 4:
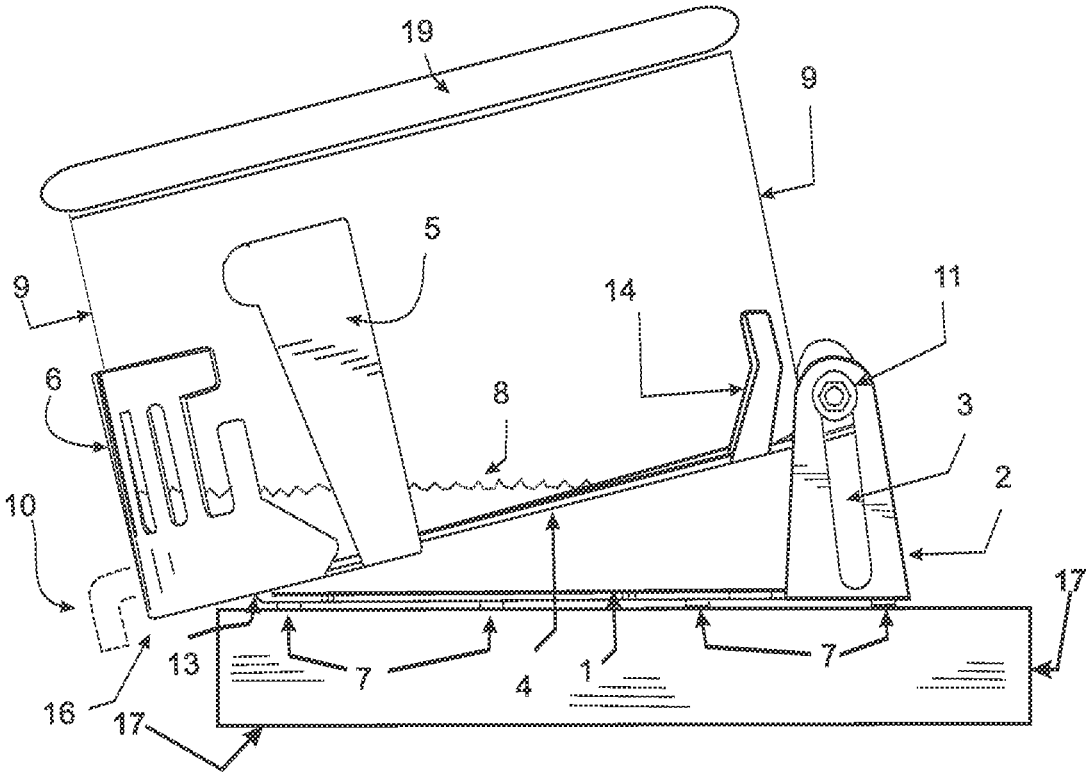
FIG. 4 is a side view of one embodiment of a system including the base, guard rail, lever range stop, platform lever, side stops, front stops, anti-skid buttons on the bottom of the base to keep the liquid container tilting apparatus from moving while in use. The lever platform is represented as if it was in the full up position. The liquid container with spout or spigot is represented in the tilted position with the dregs of the liquid pooling above the spout or spigot drain hole.

Referring to FIG. 4, is a side view of one embodiment of the liquid container tilting apparatus including the base 1, lever range stop 2 with travel limit opening 3, platform lever 4, side stabilizers 14, anti-skid buttons 7, acute angle fold 13, and the nut and washer on the platform lever stop bolt 11. It includes the basket with side arms 5 and front fence 6, including the representation of a liquid container 9, with the top level of the liquid 8, depicted at or above the bottom of the spigot/spout and interior drain opening 10. The lever platform is represented as if it is in the full up or tilting position.

Figure 5:
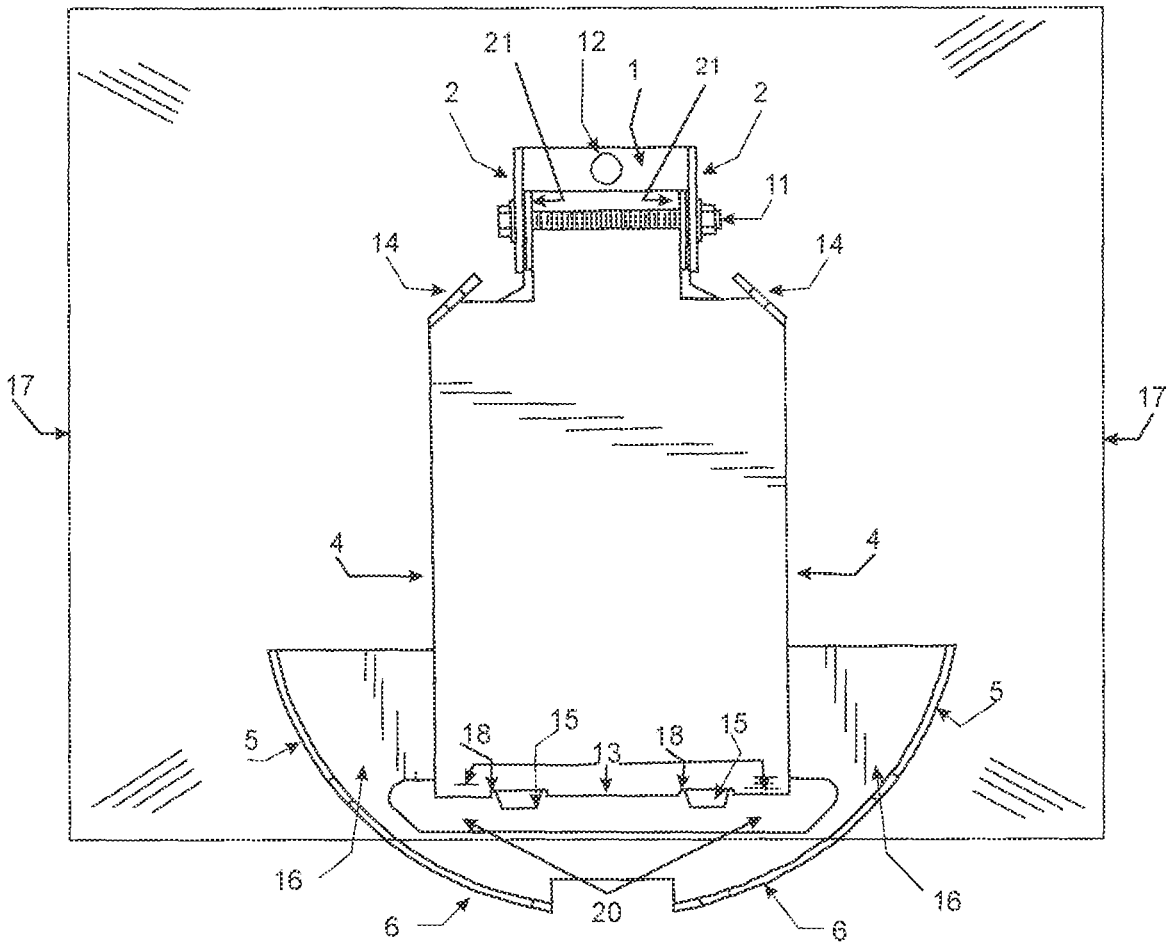
FIG. 5 is a flat plate top down view of the liquid container tilting apparatus after it is folded and assembled. Focusing on the top half of the liquid container tilting apparatus, it includes the platform lever, side stops, front stops, bolt anchors, and platform lever stops.

Referring to FIG. 5, a top-down flat elevation view of the assembled liquid container tilting apparatus after it is folded and the basket is attached to the platform lever, including the base 1, platform lever 4, lever range stop 2, side stabilizers 14, acute angle fold 13, positioning pegs 15, opening used to attach the basket to the platform lever 20, bolt anchors 21, nut and washer on the platform lever stop bolt 11, basket 16 with side arms 5, front fence 6.

Figure 6:
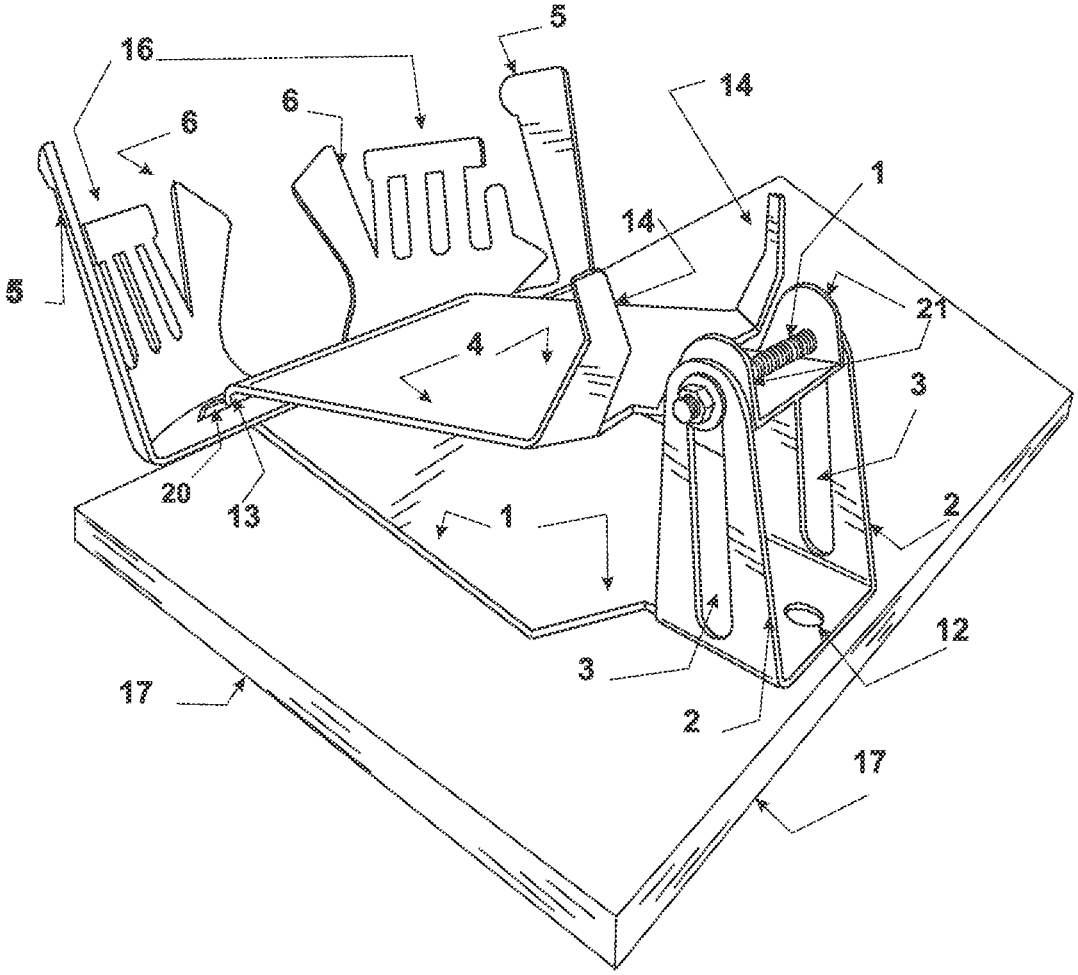
FIG. 6 is a rear-side elevation view including the base, platform lever, lever range stop, with travel limit opening, rear and side stabilizers, acute angle fold, opening used to attach the basket to the platform lever, hang hole, bolt anchors; nut, bolt, and washer lever stop bolt, basket with side arms, and front fences.

Referring to FIG. 6, a rear-side elevation view including the base 1, platform lever 4, lever range stop 2 with travel limit opening 3, rear and side stabilizers 14, acute angle fold 13, opening used to attach the basket to the platform lever 20, bolt anchors 21, hang hole 12, nut, bolt, and washer lever stop bolt 11, basket 16 with side arms 5, and front fence 6.

Figure 7:
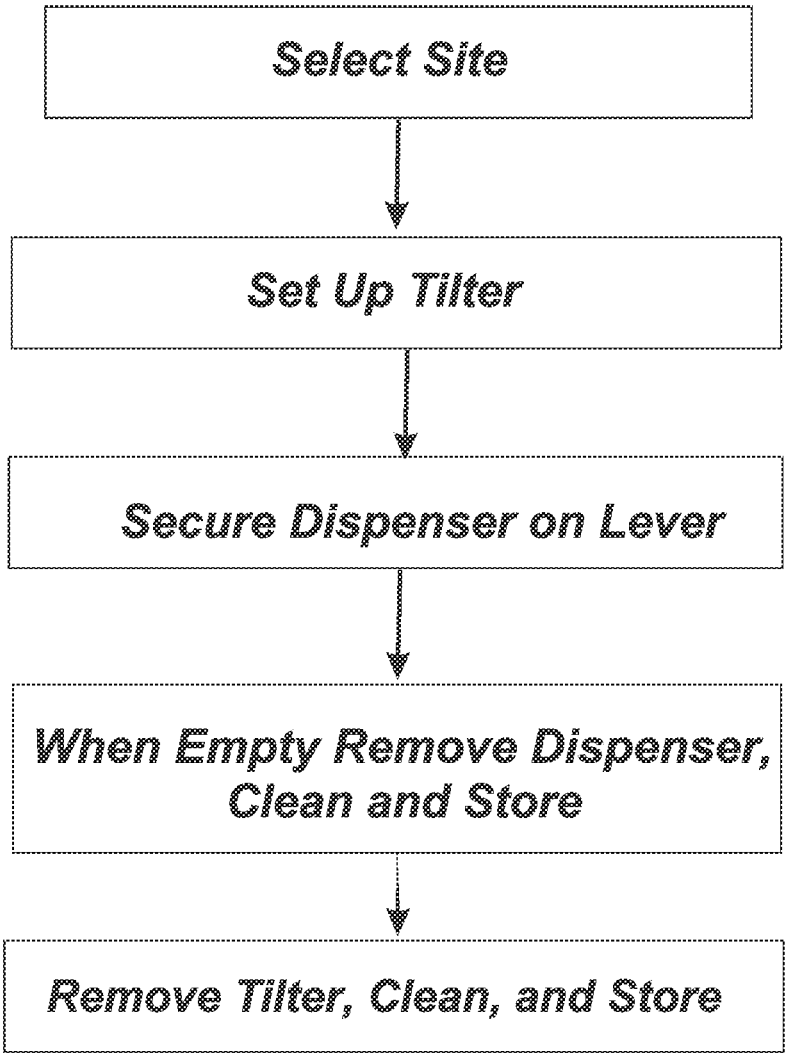
FIG. 7 represents a schematic block diagram of the procedural steps for using the liquid container tilting apparatus, whereby one embodiment of the system may be implemented and maintained.

Referring to FIG. 7, a schematic block diagram of the procedural steps for using the liquid container tilting apparatus, whereby one embodiment of the system may be implemented and maintained.

Figure 8:
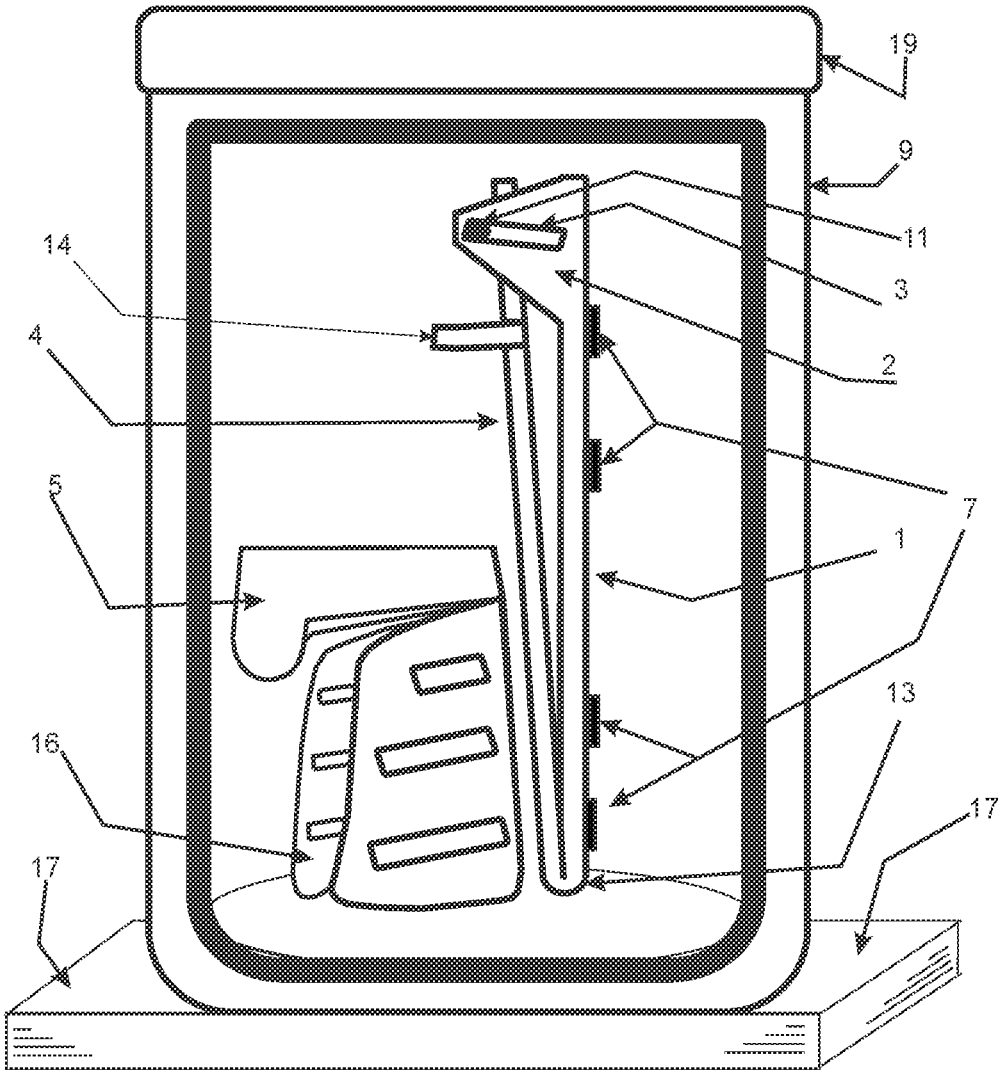
FIG. 8, represents the liquid container tilting apparatus disassembled and stored in a 5-gallon liquid dispensing jug. The liquid container tilting apparatus includes the base, the lever range guide, travel limit opening, platform lever, side arms, front fence, anti-skid buttons, liquid container, spigot/spout drain opening, nut and washer on the platform lever stop bolt, hinge fold, positioning pegs, basket, supporting surface, liquid container lid. The platform is represented in the full up position.

Referring to FIG. 8, represents the liquid container tilting apparatus stored in a 5-gallon liquid dispensing container. The liquid container tilting apparatus includes the base 1, the lever range guide 2, travel limit opening 3, platform lever 4, side arms 5, front fences 6, anti-skid buttons 7, liquid container 9, nut and washer on the platform lever stop bolt 11, hinge fold 13, positioning pegs 15, supporting surface 17, liquid container lid 19. The platform is represented in the full down position.

Figure 9:
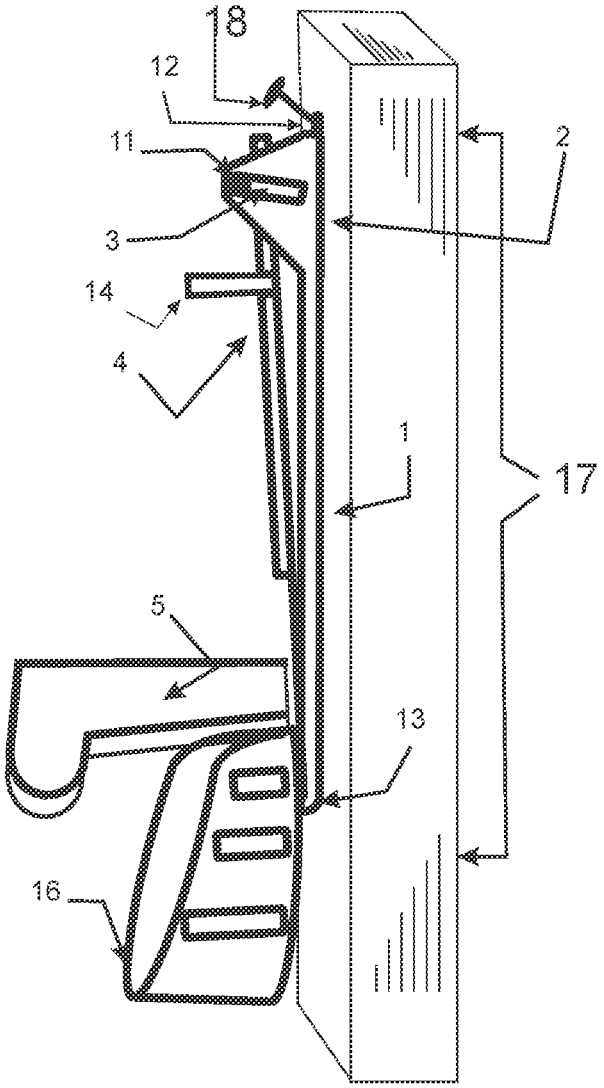
FIG. 9 represents the liquid container tilting apparatus including the base, the lever range guide, travel limit opening, platform lever, side arms, front fence, anti-skid button, nut and washer on the platform lever stop bolt, storage hang hole w/nail, hinge fold, vertical supporting surface (post or wall). The platform is represented in the full down position.

Referring to FIG. 9, represents the liquid container tilting apparatus including the base 1, the lever range guide 2, travel limit opening 3, platform lever 4, side arms 5, front fences 6, nut and washer on the platform lever stop bolt 11, storage hang hole 12, w/nail 18, hinge fold 13, vertical supporting surface (post or wall) 17. The platform is represented in the full up position.

Figure 10:
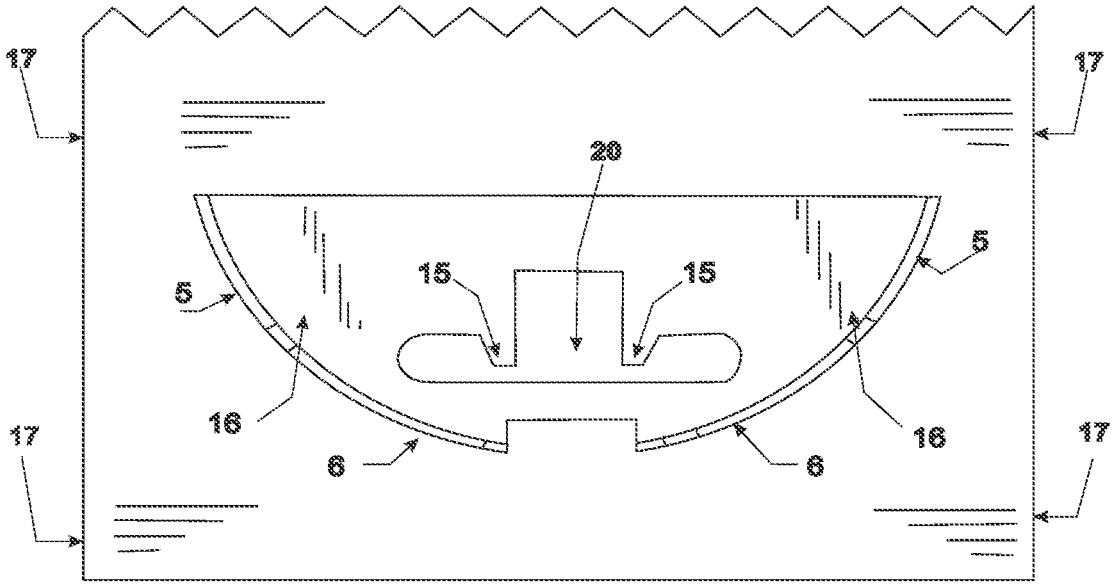
FIG. 10, is a top down view of the basket identifying the basket base, fences, arms, alignment pegs, support structure, and opening used to attach the liquid container tilting apparatus lever platform and base.

Referring to FIG. 10, is a top down view of the basket identifying the basket base 16, fences 6, arms 5, alignment pegs 15, support structure 17, and opening 20 used to attach the liquid container tilting apparatus lever platform and base.

What is claimed and desired to be secured by United States Letters Patent is:

1. A liquid container tilting apparatus consisting of three primary parts:

a base comprising a top surface, a bottom surface, lever range guides and travel limit openings, said bottom surface is provided with anti-skid buttons and a nail hole, wherein said base fitted to rest on a supporting surface and the anti-skid buttons is effective in protecting the supporting surface and keeping the base from moving on the supporting surface;

a platform lever comprising a portion of the base, rectangular in shape with bolt anchors, the platform lever and the base are made of a resilient material, folded laterally at a point forming an acute angle with two slots that defines the base and the platform lever such that, when the tilting apparatus is used, the base is stationary on the supporting surface and the platform lever raises to tilt a liquid container with liquid;

a basket, to secure the liquid container to the platform lever; the basket comprised of a bottom; side arms, front fences, positioning pegs, and rear stabilizing guides; the bottom has a slot opening that allows the basket to be attached or removed from the platform lever; the positioning pegs are used to align the basket with said two slots, allowing the basket to be secured to the platform lever; said rear stabilizing guides define the position of the liquid container on the platform lever and provide stability to the container as the container is tilted; when the tilting apparatus is used, the platform lever is compressed by the weight of the liquid within the liquid container creating kinetic energy that is stored in both the base and the platform lever for lifting and tilting the liquid container from a flat position aligned in relation with the base; the bottom of the platform lever touches the base when the liquid container is full of said liquid; a platform lever stop bolt, keeps the platform lever from tilting via said platform lever bolt anchors beyond an optimum drain angle as the liquid is drained from the container out a spigot/spout; as the total weight of the liquid container on the platform lever decreases, the platform lever and liquid container gradually tilt up such that the level of the remaining liquid, inside the container, stays above the spigot/spout, allowing a maximum amount of said liquid to empty from the liquid container; once the liquid has been dispensed from the liquid container, the liquid container tilting apparatus can be disassembled and cleaned for storage inside said liquid container or hung on a nail using said nail hole.

* * * * *